US005829463A

United States Patent [19]

Galan

[11] Patent Number: 5,829,463

[45] Date of Patent: Nov. 3, 1998

[54] CRUTCH TIP AND METHOD OF MAKING THE SAME

[76] Inventor: Juan Caro Galan, C/. Hondores. 4, 11500 El Puerto de, Santa Maria, Spain

[21] Appl. No.: 855,635

[22] Filed: May 13, 1997

[30] Foreign Application Priority Data

May 16, 1996 [ES] Spain ..... 9601085

[51] Int. Cl.[6] ..... A45B 9/04

[52] U.S. Cl. ..... 135/77; 135/84; 135/68; 135/70

[58] Field of Search ..... 135/77, 78, 80, 135/81, 84, 86, 65, 70, 68

[56] References Cited

U.S. PATENT DOCUMENTS

| | | | |
|---|---|---|---|
| 3,738,674 | 6/1973 | Pauls | 135/70 X |
| 4,493,334 | 1/1985 | Semanchik et al. | 135/84 X |
| 4,899,771 | 2/1990 | Wilkinson | 135/84 X |
| 5,224,506 | 7/1993 | Allen et al. | 135/77 X |
| 5,236,222 | 8/1993 | Fletcher | 135/77 X |
| 5,331,989 | 7/1994 | Stephens | 135/77 X |

*Primary Examiner*—Winnie Yip

[57] ABSTRACT

An improved tip for a crutch or cane includes a heel portion extending rearwardly from the tip at an upward angle such that the bottom surface of the heel portion frictionally engages the floor when the cane is tilted rearwardly from a vertical. The heel is made of rubber or other high friction material and is provided with treads on its bottom surface to enhance frictional engagement of the floor.

5 Claims, 1 Drawing Sheet

CRUTCH TIP AND METHOD OF MAKING THE SAME

BACKGROUND OF THE INVENTION

The present invention relates to improvements in the rubber tip attached to the bottom or distal end of a crutch or cane.

The rubber tip attached to the bottom end of a crutch is generally frusto-conical with a bottom surface having one or more annular or circular recesses defined therein. The recesses define treads that increase frictional engagement between the bottom of the crutch and the ground or floor to thereby minimize slippage when the user of the crutch is in motion. When the crutch is used in an orientation other than that in which the bottom surface of the tip is flush with the ground or floor, only a very small arcuate section of the edge of the bottom tip surface engages the ground or floor. Such an orientation is generally effected when a crutch user is seated and attempts to rise from his/her seat. Specifically, when using a crutch to rise from a seat, the user will generally find it difficult to keep the crutch vertically oriented and will naturally tend to tilt the crutch. When only a small arcuate section of the crutch tip engages the ground or floor, the treads are ineffective and the friction between the crutch tip and the ground or floor is minimal. Often, the crutch slips as the user of the crutch is rising, resulting in the user falling to the floor and possibly injuring himself/herself.

It is an object of the invention to overcome the aforesaid disadvantages of prior art crutch tips.

SUMMARY OF THE INVENTION

In accordance with the present invention, the crutch tip is designed with a bottom portion in the form of an upwardly sloped extension or heel projecting rearwardly from the bottom edge of the tip. The extension is provided with treads on its bottom surface and, by virtue of its rearward and upward slope, provides a treaded surface that engages the ground or floor when the crutch is tilted backwardly as the user is rising from a seated position. The additional surface area provided by the extension, combined with the tread, permits the crutch user to safely and securely rise from his or her seat without the crutch slipping or sliding along the ground or floor.

DESCRIPTION OF THE PREFERRED EMBODIMENTS

Figure 1:
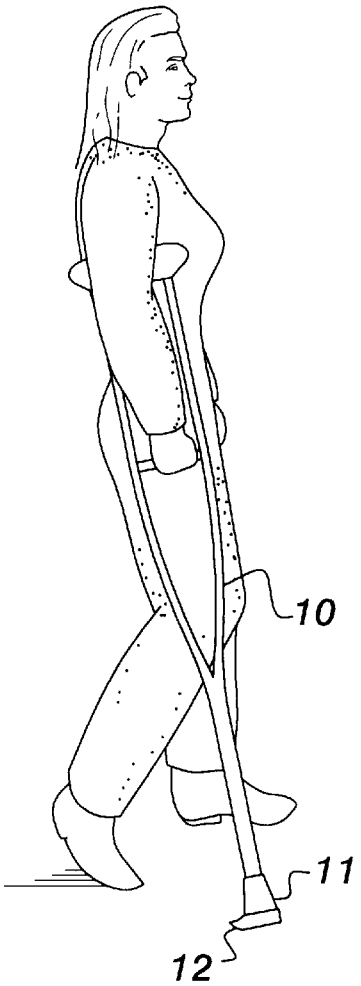
FIG. 1 is a depiction of a person using a crutch fitted with the improved tip of the present invention.

Referring to FIG. 1, a conventional crutch 10 is illustrated with the novel tip 11 of the present invention secured to the bottom or distal end of the crutch. It will be noted that tip 11 includes a heel or rearward extension 12 that slopes upwardly and rearwardly from the bottom surface of the tip. The bottom surface of heel 12 slopes at an angle of approximately 30° relative to the bottom surface of tip 11, but this angle can be anywhere in the range from 15° to 45°. The slope is best illustrated in FIG. 2.

Figure 3:
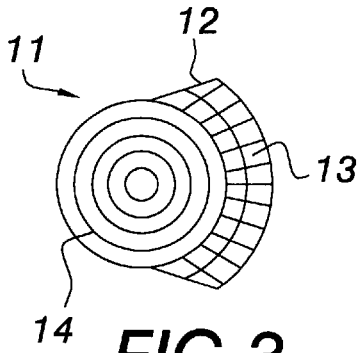
FIG. 3 is a bottom view in plan of the improved crutch tip of the present invention.

Referring to FIG. 3, the bottom surface of heel 12 includes a plurality of treads providing for greater frictional engagement between that surface and the ground or floor when the bottom surface of heel 12 is flush or close to flush with the floor.

Figure 2:
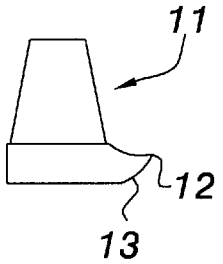
FIG. 2 is a side view in elevation of the improved crutch tip of the present invention.

As best illustrated in FIG. 2, the thickness of heel 12 tapers rearwardly so that the thicker portion of the heel close to the main tip body minimizes flexure of the extension when weight of the user is put on the tilted tip bottom. The result is a stable treaded surface that supports the user's weight as he/she rises from a seated position or climbs the stairs.

The crutch tip 11, apart from extension 13, has a conventional bottom surface with annular treads 14 that serve in a well known manner to frictionally engage the ground or floor as a user walks with the aid of the crutch. The treads increase traction and prevent the crutch bottom from sliding and slipping along a surface. Heel 12, because it slopes upwardly, does not come into play during the normal walking mode. It is only when the user of the crutch must tilt the crutch (e.g., when rising from a seat, walking up stairs, etc.) that heel 12 and its treads 13 on its lower surface come into play. Under such circumstances, heel 12 minimizes any tendency of the rubber tip to slide along a surface on which the tilted crutch is supported under the weight of the crutch user.

Figure 4:
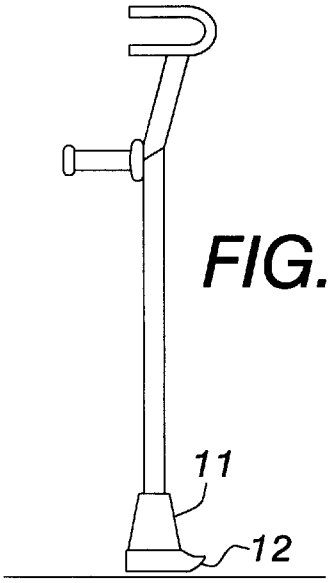
FIG. 4 is a view in elevation of a vertically oriented cane fitted with the tip of the present invention.
Figure 5:
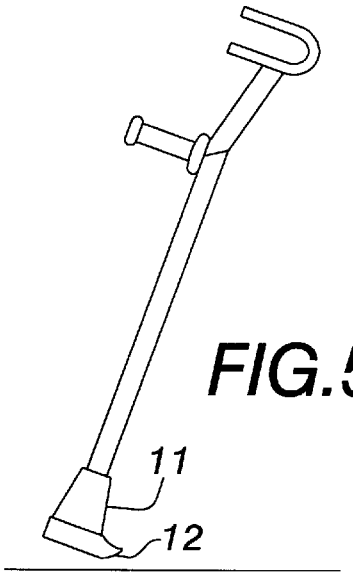
FIG. 5 is a view in elevation of the cane of FIG. 4 shown tilted at an angle from vertical.

The crutch heel of the present invention is useful for both crutches and canes. By way of example, a type of cane is illustrated in FIGS. 4 and 5. In FIG. 4, the cane is shown in a substantially vertical orientation where the bottom surface of the rubber cane tip functions in a normal manner. In FIG. 5, the cane is shown tilted backwardly so that the bottom surface of the tip heel engages the ground or floor, thereby providing greater friction and minimizing any tendency of the cane to slide along the ground or floor.

Although the cane or crutch tip of the present invention has been described as being made of rubber, it is to be understood that the tip can be made of other suitable material such as plastic that is capable of frictionally engaging a surface on which the user of the cane or crutch would support himself or herself by means of the cane or crutch. While the resiliency inherent in rubber is preferred for the tip material, it is possible to use a non-resilient material as long as it has a sufficiently high coefficient of friction to prevent the tip from sliding along a floor or other surface upon which the cane or crutch is urged in use. It should also be noted that, although the entire tip 11 is described above as being made from one piece of material, it is possible for heel portion 12 to be made from a separate piece of material and secured to a conventional tip for a cane or crutch.

I have disclosed an improved construction of a tip for a cane or crutch having a rear extension that effectively extends the tip surface to prevent the tip from slipping and the user from falling. Treads on the lower surface of the extension increase traction to minimize slippage. The tip is easily attached to and removed from the bottom of a cane by simple hand pressure and friction fit in a conventional manner.

What is claimed is:

1. An improved tip for engaging a floor or the ground, comprising:

a base portion adapted to receive a distal end of a crutch or a distal end of a cane and having a circular bottom surface on which is formed a plurality of concentric circular treads configured to frictionally engage the floor or the ground during a normal walking mode; and a heel portion extending from a side of said base portion in a rearward direction and having a bottom surface that is sloped upwardly at an angle with respect to the circular bottom surface of said base portion such that said heel portion is ineffective in preventing slippage during the normal walking mode, the bottom surface of said heel portion having a plurality of treads, different from the concentric circular treads, configured to be flush against the floor or the ground when said tip is tilted rearwardly at said angle from a vertical position.

2. The improved tip of claim 1 wherein said heel portion is formed as a single piece with said base portion.

3. The improved tip of claim 2 wherein said tip is made of rubber.

4. The improved tip of claim 1 wherein said heel portion has a thickness in a vertical dimension that tapers rearwardly to provide minimal flexure of the heel portion where it joins the base portion.

5. A method of constructing an improved tip of a crutch or a cane, for preventing slippage when used by a person rising from a seated position, the method comprising the steps of:

forming the tip of the crutch or the cane as a base portion having a circular bottom surface with circular concentric treads configured to frictionally engage a floor or the ground during a normal walking mode;

extending a heel portion rearwardly from the base portion, the heel portion having a bottom surface that is sloped upwardly at an angle with respect to the circular bottom surface of the base portion such that the heel portion is ineffective in preventing slippage during the normal walking mode; and forming a plurality of treads, different from the concentric circular treads, on the bottom surface of the heel portion, which are configured to be flush against the floor or the ground when the tip is tilted rearwardly at said angle from a vertical position.

* * * * *